United States Patent [19]

Okada et al.

[11] Patent Number: 4,505,457

[45] Date of Patent: Mar. 19, 1985

[54] RAILWAY TRUCK SPRING HEIGHT ADJUSTMENT DEVICE

[75] Inventors: Yukio Okada, Amagasaki; Akira Iwamura, Kobe, both of Japan

[73] Assignee: Kawasaki Jukogyo Kabushiki Kaisha, Kobe, Japan

[21] Appl. No.: 384,675

[22] Filed: Jun. 2, 1982

[30] Foreign Application Priority Data

Jun. 5, 1981 [JP] Japan ..... 56-83543[U]

[51] Int. Cl.[3] ..... B61F 5/50; F16F 1/26; F16M 7/00

[52] U.S. Cl. ..... 267/3; 105/197 R; 105/199 R; 105/453; 267/175; 267/176; 267/177

[58] Field of Search ..... 105/182 R, 197 R, 199 R, 105/453; 267/3, 4, 175, 176, 177, 178, 179

[56] References Cited

U.S. PATENT DOCUMENTS 2,523,375 9/1950 Jones et al. ..... 267/4

3,586,306 6/1971 Reece et al. ..... 267/3

*Primary Examiner*—Howard Beltran

*Attorney, Agent, or Firm*—Leydig, Voit, Osann, Mayer and Holt, Ltd.

[57] ABSTRACT

A height adjusting device for the truck of a railroad vehicle including spring retainer supporting members consisting of a plurality of concentric segments which are arranged around the axis of a spring retainer in symmetry with respect to the axis. Each segment has an upper surface which is so stepped that the height thereof is successively increased as the distance of the upper surface from the spring axis increases, providing thereby a plurality of horizontal supporting surfaces, and a tongue or groove for locating and fixing the segment. The spring height can easily be adjusted simply by changing the position of the segments relative to the spring retainer.

6 Claims, 9 Drawing Figures

RAILWAY TRUCK SPRING HEIGHT ADJUSTMENT DEVICE

BACKGROUND OF THE INVENTION

1. Field of the Invention

The present invention relates to a spring height adjusting device for truck (not only bogie truck but also ordinary single truck) of railroad vehicles and, more particularly, to a device for adjusting the height of the floor of the vehicle chassis from the rail surface, the chassis being mounted on and supported by the truck through a spring device.

2. Description of the Prior Art

Generally, the tread surfaces of wheels of railroad vehicles are worn during long use thereby reducing the diameters of the wheels. In addition, mechanical work such as grinding is conducted periodically on the treads of wheels to maintain precisely circular form of the wheels. As a consequence, the height or level of the chassis floor from the ground level is decreased by an amount corresponding to the reduction in diameter of the wheels. It is, therefore, necessary to correct or readjust the chassis floor level from the ground level in the factory as required.

In a railroad vehicle, a spring device (coiled spring or pneumatic spring) is disposed between the chassis and transverse beam or longitudinal member equivalent in effect to the transverse beam (such beam or member will be referred to as "base member" hereinunder regardless of the authorized technical term which varies depending on the construction and type of the truck). The correction or readjustment of the height of the chassis floor is usually made by inserting an adjusting plate or plates of predetermined thickness between the lower surface of a spring retainer which may be integral with the spring and the upper surface of the truck, or alternatively, between the upper surface of the spring retainer and the lower surface of the chassis.

A typical example of such adjustment will be explained in connection with FIG. 1 (prior art). A two-axle bogie truck generally designated by a numeral 1 has a pair of base members or side frames 2 arranged at both sides along the length of the railroad truck. A wheel set 6 is rotatably attached to each end of each base member 2 through an axle spring 3, axle box 4 and an axle 5. The weight of the chassis 8 is born by a coiled spring 7 which is prevented, by a spring retainer 7*a*, from moving in the horizontal direction. In order to adjust the spring height, an adjusting plate 9 of a suitable thickness is placed in contact with the lower surface of each spring retainer 7*a*. Namely, at each side of the chassis, the adjusting plate 9 is disposed and fixed to the base member 2 at longitudinally mid point of the latter. More specifically, a center pin 7*b* projecting from the lower surface of the spring retainer 7*a* is fitted in a locating bore formed in a predetermined portion of the upper surface of the base member 2. A central hole formed in the adjusting plate 9 receives the center pin 7*b* of the spring retainer.

For correcting or readjusting the spring height, i.e., the height or level of the floor of the chassis 8 from the level of the upper face of the rail 10, the spring retainer 7*a* is raised together with the chassis 8 and the spring 7 by a jack or the like means (not shown) until the center pin 7*b* of the spring retainer 7*a* completely clears the hole in the base member 2. Then, an adjusting plate 9 of a required thickness is inserted laterally into the gap formed between the lower end of the spring retainer 7*a* and the upper face of the base member 2. After obtaining a substantial axial alignment of the center pin 7*b*, hole in the base member 2 and the central hole 9*a* of the adjusting plate 9, the spring retainer 7*a* is lowered together with the chassis 8 and the spring 7 so that the center pin 7*b* fits in the hole in the base member 2 through the central hole 9*a* of the adjusting plate. In consequence, the height or level of the floor of the chassis 8 is increased by an amount corresponding to the increase of the thickness of the adjusting plate 9 interposed between the lower face of the spring retainer 7*a* and the base member 2, thus completing the correction or readjustment of the level from the rail surface.

Thus, the correction or readjustment is made in accordance with the change or decrease of the radius of the tread surface of the wheel 6 by stacking a plurality of adjusting plates of suitable thicknesses or by means of a single adjusting plate having a thickness equal to the total thickness of the stacked adjusting plates, in the manner explained hereinbefore. This conventional method of the height correction or readjustment requires a multiplicity of adjusting plates of a large variety of thicknesses to be stored in the factory. The administration of the adjusting plate is very troublesome and requires much labor. The work itself for the correction or readjustment of height is troublesome. It is often experienced that the chassis is inconveniently declined due to inadequate height readjustment at both sides, i.e., by the use of adjusting plates of different thicknesses between the base members 2 and the spring retainers 7 at both sides of the chassis.

SUMMARY OF THE INVENTION

Accordingly, it is a primary object of the invention to provide a spring height adjusting device for railroad vehicle truck improved to eliminate the above-described problems and drawbacks of the conventional height adjusting method and device.

To this end, according to the invention, there is provided a spring height adjusting device for a railroad vehicle truck comprising a spring retainer supporting means or structure which is divided into segments symmetrical with respect to the axis of the spring retainer, each segment having a stepped upper surface, the height of which is successively increased as the distance from the axis of the spring is increased thereby to provide a plurality of spring supporting surfaces, each segment further having a tongue or groove for fixing the segment, whereby the spring height is easily adjusted by changing the position of each segment relative to the spring retainer.

The above and further objects and novel features of the invention will more fully appear from the following detailed description when the same is read in conjunction with the accompanying drawings. It is to be expressly understood, however, that the drawing is for purpose of illustration only and is not intended as a definition of the limits of the invention.

DETAILED DESCRIPTION OF THE PREFERRED EMBODIMENTS

The invention will be more fully described hereinunder through several preferred forms thereof.

Figure 1:
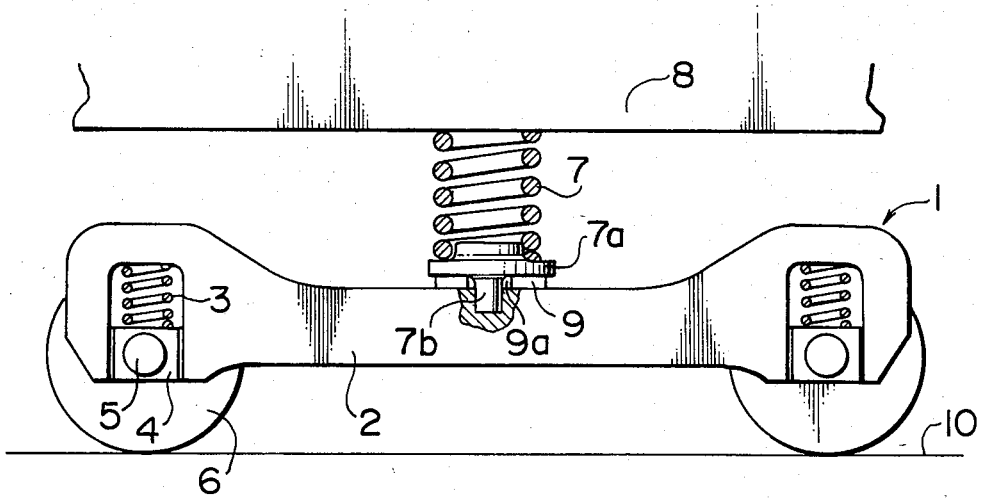
FIG. 1 PRIOR ART
FIG. 1 is a schematic side elevational view of the whole part of a truck, for explaining the conventional method for adjusting the spring height.
Figure 2:
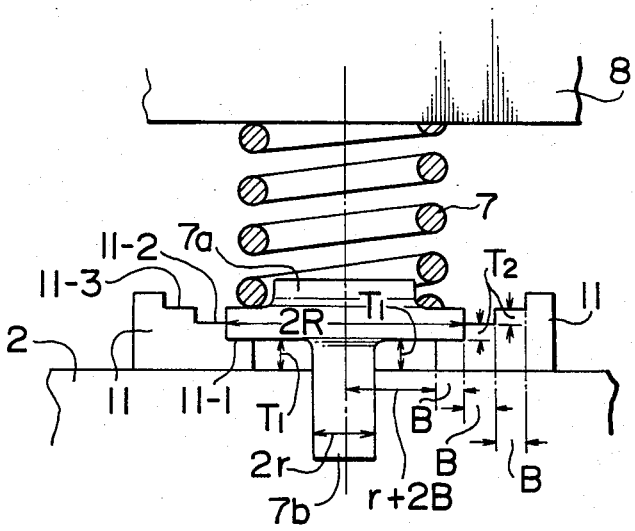
FIG. 2 is a vertical sectional view of an essential part of a device in accordance with the invention.

FIG. 2 is a vertical sectional view of a device in accordance with the invention, in which the same reference numerals are used to denote the same parts or members as those in FIG. 1. The spring height adjusting device of the invention has a spring retainer supporting member consisting of segments each of which is denoted by a numeral 11. Each segment 11 has such a stepped upper surface that the height is successively increased as it gets remote from the axis of the coiled spring 7 and the spring seat *7a* to provide a plurality of horizontal spring retainer supporting surfaces 11-1, 11-2, 11-3 . . . . These supporting surfaces are arranged substantially in symmetry with respect to the axis of the coiled spring and the spring seat and at front and rear sides or left and right sides of the spring retainer, i.e., generally at a constant circumferential pitch around the spring retainer.

Figure 3:
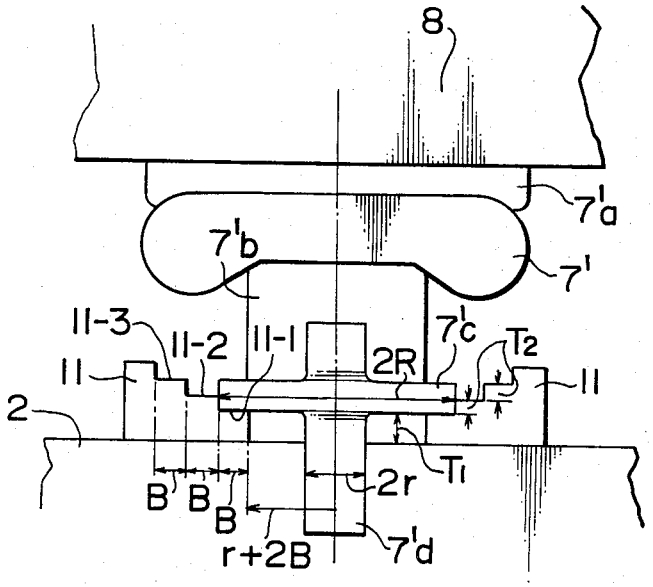
FIGS. 3 and 4 show an embodiment of the invention in which a pneumatic spring is used in place of a coiled spring.
Figure 4:
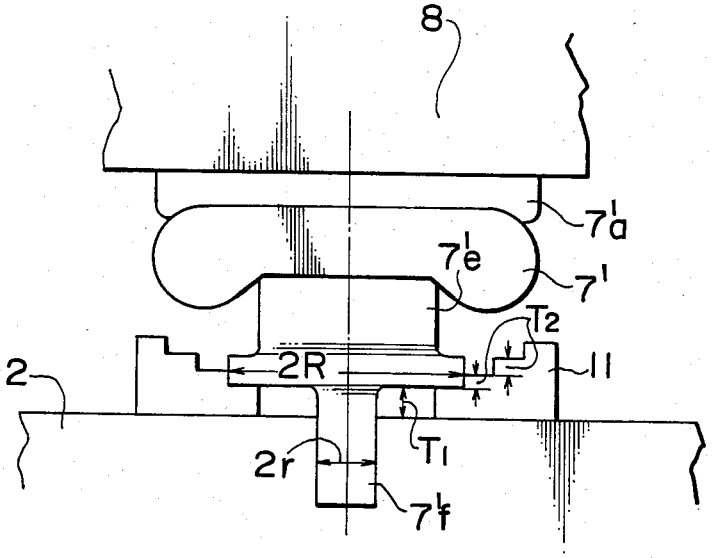

FIGS. 3 and 4 show an embodiment of the invention in which a pneumatic spring 7' is used in place of the coiled spring 7 in FIG. 2. In FIG. 3, the pneumatic spring 7' is supported between an upper mount *7'a* and a lower mount *7'b*. The lower mount *7'b* is combined with a spring retainer *7'c*. In FIG. 4, the pneumatic spring 7' is supported between an supper mount *7'a* and a lower mount *7'e* which is integral with a spring retainer.

Figure 5:
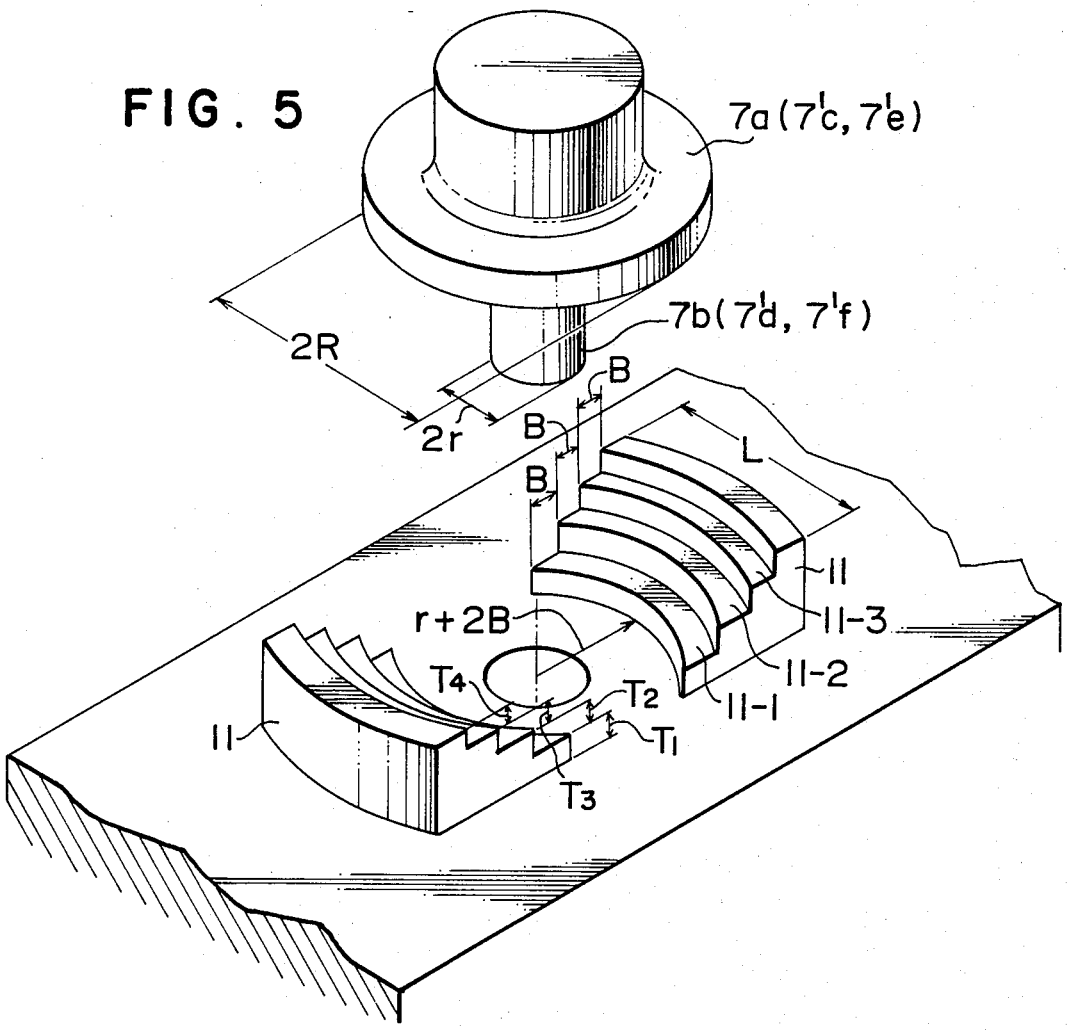
FIG. 5 is an exploded perspective view explanatory of the essential part of the device of the invention.
Figure 6:
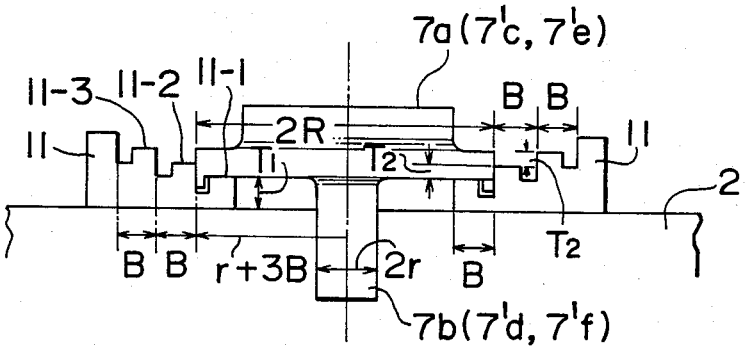
FIGS. 6 thru 9 are vertical sectional views of devices of the invention having different forms of means or structures for locating spring retainer supporting member.
Figure 7:
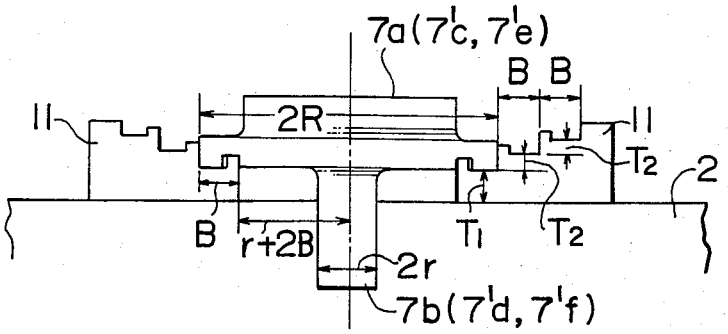
Figure 8:
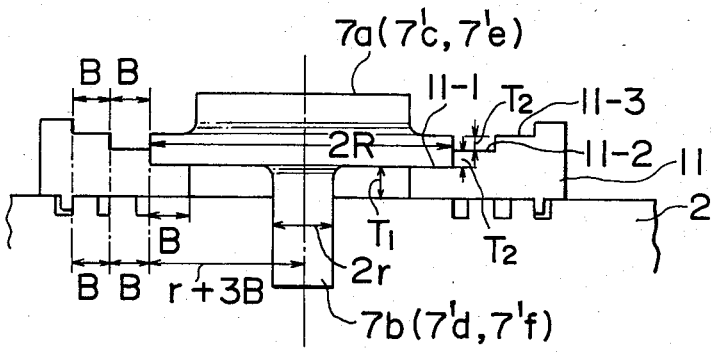
Figure 9:
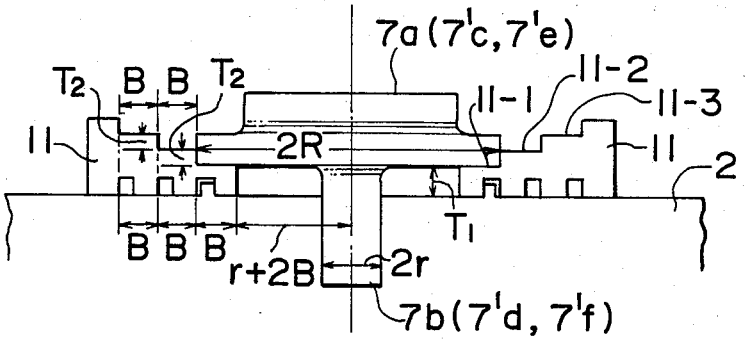

Referring now to FIG. 5, a pair of segments 11, 11 of a spring retainer supporting member, which member is movable toward and away from the axis of spring retainer and are disposed in the front and rear direction around the spring retainer *7a* (*7'c*, *7'e*) in symmetry with respect to the spring retainer. The spring retainer supporting surfaces 11-1, 11-2, 11-3 of both segments 11 formed in plurality of stages (3 stages in the illustrated case) have suitable circumferential lengths L and radial breadths B and constitute diametrically opposing portions of offset circular rings of same radius or those of concentric circular rings as will be clearly seen from FIG. 5. The height differential between adjacent horizontal supporting surfaces 11-1, 11-2, 11-3 formed in a stepped manner are generally designated at $T_1$, $T_2$ and $T_3$. These height differentials may be differentiated or, alternatively, equalized suitably as shown in FIGS. 2 to 4. The equal height difference will simplify the construction and will provide various practical advantages.

Usually, the spring retainer *7a* (*7'c*, *7'e*) is shaped in the form of a ring having a radius R when viewed in plan. Therefore, it is advantageous to form the spring seat supporting surfaces of both segment 11 as parts of rings having an equal outer radius R. In such a case, the number of stages, i.e., the steps 11-1, 11-2 . . . , is limited by various factors such as the radius R of the spring retainer *7a*, *7'c* or *7'e*, radius R of the central pin *7b*, *7'd* or *7'f* and , if the steps are formed as horizontal shelves, the breadths B of the supporting surfaces, and is generally given by a formula R-r/B.

Therefore, when the spring retainer is composed of two, three or more segments 11, these segments 11 are placed such that the innermost peripheral surface thereof substantially vertical to the upper surface of the base member 2 are positioned at a distance of r+2B from the center of the hole in the base member 2 for receiving the center pin *7b*, *7'd* or *7'f* of the spring retainer, i.e., from the center of the spring 7 or 7'. By so doing, the spring seat *7'a*, *7'c* or *7'e* are placed on the lowermost supporting surfaces 11-1 of the segments 11. To the contrary, the spring retainer is seated on the uppermost supporting surfaces 11-3 of the segments 11 when the segments are inserted deep into such positions such that their innermost peripheral surfaces substantially contact the outer peripheral surface of the center pin, as shown in FIGS. 2 to 5.

In the described embodiment, the spring retainer supporting surfaces having an equal length L and breadth B. This, however, is not essential and the length L and breadth B may be varied as desired. Needless to say, the shape of the supporting surface can be selected as desired in conformity with the shape of the spring retainer. For instance, in the case where the spring retainer has a square or rectangular planar shape, it is more convenient to make the supporting surface as a rectangular form.

In the case where the spring retainer supporting member consists of a plurality of segments which are arranged and fixed around the spring in symmetry at a substantially constant pitch, e.g. when a pair of segments are arranged at the front and rear side (in the longitudinal direction of the base memer) while another pair of segments are disposed in the direction perpendicular to the longitudinal direction, it is possible to construct the spring height adjusting device such that the heights of the supporting surfaces of segments of one pair are intermediate between the heights of the supporting surfaces of the other pair of segments.

Although neglected in FIGS. 2 to 5, the spring height adjusting device of the invention can have at the lower side of the corresponding spring retainer *7a*, *7'c* and *7'e* means or structure for adjustably and securely setting and fixing the segments 11 of the supporting member precisely onto the predetermined portions of the upper surface (loaded surface) of the base member 2. FIGS. 6 to 9 show examples of such means for locating and fixing the segments of the spring retainer supporting member.

Namely, according to the invention, one or, as required, two or more projections of suitable width, height and length are formed on either one of the lower surface of the spring retainer *7a*, *7'c* or *7'e* and the upper surfaces of the supporting surfaces 11-1, 11-2, 11-3 . . . (see FIGS. 6 and 7) while corresponding recess or recesses of the width, depth and length corresponding to those of the projection or projections are formed in the other. Alternatively, the projection or projections are formed in either one of the lower surfaces of the segments of the spring retainer supporting member and the upper surface of the base member 2 (see FIGS. 8 and 9). Preferably, the size of the recess is selected to be somewhat greater than that of the corresponding projection in order to facilitate the insertion and withdrawal of the projection to and from the recesses. Theoretically, only one combination of projecton and recess suffices for each segment of the spring retainer supporting member as will be seen from FIGS. 6 to 9. In this case, the number of recesses corresponding to the number of steps, i.e., the number of flat horizontal supporting surfaces, of each segment. Needless to say, the position of the projection and recess is determined in relation to the position of each segment of the spring retainer supporting member.

It is of course necessary to lift the spring retainer *7a*, *7'c* and *7'e* by means of a jack or the like to form a gap beneath the spring retainer for the insertion of the segments 11 of the spring retainer supporting member from the outer side. In this connection, it is recalled that, in the conventional spring height adjusting device, it is necessary to raise the spring retainer and associated members to a height at which the center pin perfectly clears the hole in the base member 2 regardless of the thickness of the adjusting plate 9 to permit the insertion of the center pin *7b* into the central hole *9a* of the adjusting plate. According to the invention, it is not necessary to lift the spring retainer to such a large height. Namely, not only the initial insertion of the segments of the spring retainer supporting member but also the alteration of the supporting surfaces for supporting the spring retainer can be made without necessitating the complete withdrawal of the center pin *7b*, *7'd* or *7'f* from the hole, i.e., with the lower end of the pin received by the hole.

No detailed explanation is provided but a glance at FIGS. 6 thru 9 is all that is needed to judge the minimum required lift of the spring retainer *7a*, *7'c* or *7'e* from the upper surface of the base member 2.

As will be seen from the foregoing description, according to the invention, it is possible to adjust the spring height simply by displacing the segments of the supporting members towards the axis of the spring 7 or 7' to bring the radially outer supporting surfaces of each segment into engagement with the lower surface of the spring retainer. Thus, according to the invention, it is possible to safely and securely adjust the spring height without taking the trouble of administration, supply and insertion of a multiplicity of adjusting plates of a large variety of thicknesses.

In the foregoing description of the embodiments, the height adjustment is effected by way of the spring retainer supporting member disposed at the lower side of the spring 7 or 7', i.e., between the lower surface of the spring retainer *7a*, *7'c* and *7'e* and the base member 2. This, however, is not exclusive and an equivalent effect is obtained by placing a spring retainer supporting member between the lower surface of the chassis 8 and the upper end of the spring 7 or 7', the supporting member consisting of a plurality of segments each having a plurality of step-like supporting surfaces of successively increased heights as in the case of the embodiments described hereinbefore. In this case, however, it is necessary that the stepped surface of the segment be directed downwardly. Other changes and modifications are possible within the scope of the invention which is limited solely by the appended claims.

What is claimed is:

1. A height adjusting device for a truck of a railroad vehicle having a chassis comprising a spring adapted to support the chassis of said vehicle on a base member, a spring retainer provided with a center pin and at least one spring retainer supporting member movable toward and away from the axis of said spring retainer and having a plurality of concentric segments arranged and fixed around said spring and spring retainer in symmetry with respect to the axis of said spring and spring retainer at a constant circumferential pitch, each of said concentric segments having an upper surface which is stepped in such a manner that the height thereof is successively increased in a stepped manner as the distance of said upper surface from the spring axis increases, thereby providing a plurality of horizontal spring retainer supporting surfaces, said device further comprising adjustable securing means adapted to locate and fix each of said concentric segments of said spring retainer supporting member at a predetermined position relative to the axis of said spring.

2. A height adjusting device for a truck of a railroad vehicle according to claim 1 wherein said adjustable securing means includes a combination of at least one projection of a suitale width, height and length formed in one of two abutting surfaces constituting loaded surfaces, and a plurality of recesses corresponding in number to the steps of each segment of said spring retainer supporting member, said recesses being formed in the other of said abutting surfaces constituting said loaded surfaces and having suitable width, depth and length.

3. A height adjusting device for a truck of a railroad vehicle according to claim 2, wherein said spring retainer supporting surfaces are constituted by parts of concentric rings and have a suitable length and breadth.

4. A height adjusting device for a truck of a railroad vehicle according to claim 2, wherein said abutting surfaces comprise the upper surface of said base member and the surface of said segment opposite to said spring retainer supporting surfaces.

5. A height adjusting device for a truck of a railroad vehicle according to claim 2, wherein said abutting surfaces comprise the lower surface of said spring retainer and the upper surfaces of each of said spring retainer supporting member.

6. A height adjusting device for a truck of a railroad vehicle according to any one of claims 1 or 2, wherein said spring retainer supporting surfaces are constituted by parts of offset circular rings of an equal diameter and having a suitable length and breadth.

* * * * *